US006164443A

United States Patent [19]

Mitchell et al.

[11] Patent Number: 6,164,443

[45] Date of Patent: Dec. 26, 2000

[54] TOBACCO WRAPPING PAPER

[76] Inventors: Donald G. Mitchell, 320 N. Lime St. #2B; Gerardo Soto, 811 S. Lime St., both of Lancaster, Pa. 17602

[21] Appl. No.: 09/022,683

[22] Filed: Feb. 12, 1998

[51] Int. Cl.[7] ..... A24F 15/00

[52] U.S. Cl. ..... 206/242; 206/256; 206/271; 206/499; 206/524.3; 131/347; 131/365; 150/137; 162/139

[58] Field of Search ..... 206/242, 256, 206/215, 499, 524.6, 524.3, 524.1, 813, 271, 814; 383/63; 150/137; 162/139; 131/365, 347

[56] References Cited

U.S. PATENT DOCUMENTS

| | | | |
|---|---|---|---|
| 521,116 | 6/1894 | Ingram | 206/39.4 |
| 1,512,000 | 10/1924 | Peterson | 206/242 |
| 1,809,218 | 6/1931 | Riddell | 131/365 |
| 3,385,602 | 5/1968 | Wattenford | 131/4 |
| 4,832,057 | 5/1989 | Bale et al. | 131/73 |
| 5,109,876 | 5/1992 | Hayden et al. | 131/365 |
| 5,622,431 | 4/1997 | Simonsen | 383/63 |
| 5,632,287 | 5/1997 | Hayworth et al. | 131/360 |
| 5,749,461 | 5/1998 | Guzman | 206/245 |
| 5,762,074 | 6/1998 | Garner | 131/360 |

*Primary Examiner*—Paul T. Sewell
*Assistant Examiner*—Trinh Nguyen

[57] ABSTRACT

A new tobacco wrapping paper for allowing a person to roll their own cigars. The inventive device includes a plurality of tobacco sheets of wrapping paper. The tobacco sheets of wrapping paper are comprised of a blend of tobacco and pulp products. The tobacco sheets each have a generally rectangular configuration defined by opposed long edges and opposed short edges. Each of the tobacco sheets have a layer of adhesive disposed thereon inwardly of one of the opposed long edges thereof. A package is dimensioned for containing the plurality of tobacco sheets therein.

2 Claims, 4 Drawing Sheets

TOBACCO WRAPPING PAPER

BACKGROUND OF THE INVENTION

1. Field of the Invention

The present invention relates to tobacco products and more particularly pertains to a new tobacco wrapping paper for allowing a person to roll their own cigars.

2. Description of the Prior Art

The use of tobacco products is known in the prior art. More specifically, tobacco products heretofore devised and utilized are known to consist basically of familiar, expected and obvious structural configurations, notwithstanding the myriad of designs encompassed by the crowded prior art which have been developed for the fulfillment of countless objectives and requirements.

Known prior art tobacco products include U.S. Pat. No. 5,078,156 to Furuya et al.; U.S. Pat. No. 5,377,698 to Litzinger et al.; U.S. Pat. No. 5,191,906 to Myracle, Jr.; U.S. Pat. No. 5,228,464 to Owens, Jr.; U.S. Pat. No. 4,114,629 to Sedlacek et al.; and U.S. Pat. No. Des. 341,490 to Curran et al.

While these devices fulfill their respective, particular objectives and requirements, the aforementioned patents do not disclose a new tobacco wrapping paper. The inventive device includes a plurality of tobacco sheets of wrapping paper. The tobacco sheets of wrapping paper are comprised of a blend of tobacco and pulp products. The tobacco sheets each have a generally rectangular configuration defined by opposed long edges and opposed short edges. Each of the tobacco sheets have a layer of adhesive disposed thereon inwardly of one of the opposed long edges thereof. A package is dimensioned for containing the plurality of tobacco sheets therein.

In these respects, the tobacco wrapping paper according to the present invention substantially departs from the conventional concepts and designs of the prior art, and in so doing provides an apparatus primarily developed for the purpose of allowing a person to roll their own cigars.

SUMMARY OF THE INVENTION

In view of the foregoing disadvantages inherent in the known types of tobacco products now present in the prior art, the present invention provides a new tobacco wrapping paper construction wherein the same can be utilized for allowing a person to roll their own cigars.

The general purpose of the present invention, which will be described subsequently in greater detail, is to provide a new tobacco wrapping paper apparatus and method which has many of the advantages of the tobacco products mentioned heretofore and many novel features that result in a new tobacco wrapping paper which is not anticipated, rendered obvious, suggested, or even implied by any of the prior art tobacco products, either alone or in any combination thereof.

To attain this, the present invention generally comprises a plurality of tobacco sheets of wrapping paper. The tobacco sheets of wrapping paper are comprised of a blend of tobacco and pulp products. The tobacco sheets each have a generally rectangular configuration defined by opposed long edges and opposed short edges. Each of the tobacco sheets has a layer of adhesive disposed thereon inwardly of one of the opposed long edges thereof. A plurality of cellophane sheets are positioned intermittently between the plurality of tobacco sheets. The cellophane sheets each have a generally rectangular configuration defined by opposed long edges and opposed short edges. The cellophane sheets have a length and width greater than a length and width of the tobacco sheets. One of the opposed short edges of each of the cellophane sheets has a tab extending outwardly therefrom. A package is dimensioned for containing the plurality of tobacco sheets and the plurality of cellophane sheets therein. The package comprises a planar bottom wall for receiving tobacco sheets and cellophane sheets thereon. The planar bottom wall has a short inwardly foldable front wall and short opposed inwardly foldable side walls extending upwardly therefrom. A long inwardly foldable rear wall extends upwardly from a rear edge of the planar bottom wall. The foldable rear wall is dimensioned for covering the bottom wall and the front wall and side walls in a closed orientation. The bottom wall has a sealing tab extending outwardly from a forward edge thereof for engaging the rear wall in the closed orientation.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new tobacco wrapping paper apparatus and method which has many of the advantages of the tobacco products mentioned heretofore and many novel features that result in a new tobacco wrapping paper which is not anticipated, rendered obvious, suggested, or even implied by any of the prior art tobacco products, either alone or in any combination thereof.

It is another object of the present invention to provide a new tobacco wrapping paper which may be easily and efficiently manufactured and marketed.

It is a further object of the present invention to provide a new tobacco wrapping paper which is of a durable and reliable construction.

An even further object of the present invention is to provide a new tobacco wrapping paper which is susceptible of a low cost of manufacture with regard to both materials and labor, and which accordingly is then susceptible of low prices of sale to the consuming public, thereby making such tobacco wrapping paper economically available to the buying public.

Still yet another object of the present invention is to provide a new tobacco wrapping paper which provides in the apparatuses and methods of the prior art some of the advantages thereof, while simultaneously overcoming some of the disadvantages normally associated therewith.

Still another object of the present invention is to provide a new tobacco wrapping paper for allowing a person to roll their own cigars.

Yet another object of the present invention is to provide a new tobacco wrapping paper which includes a plurality of tobacco sheets of wrapping paper. The tobacco sheets of wrapping paper are comprised of a blend of tobacco and pulp products. The tobacco sheets each have a generally rectangular configuration defined by opposed long edges and opposed short edges. Each of the tobacco sheets have a layer of adhesive disposed thereon inwardly of one of the opposed long edges thereof. A package is dimensioned for containing the plurality of tobacco sheets therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1, and FIG. 1A, is a perspective view of a new tobacco wrapping paper according to the present invention.

DESCRIPTION OF THE PREFERRED EMBODIMENT

Figure 1:
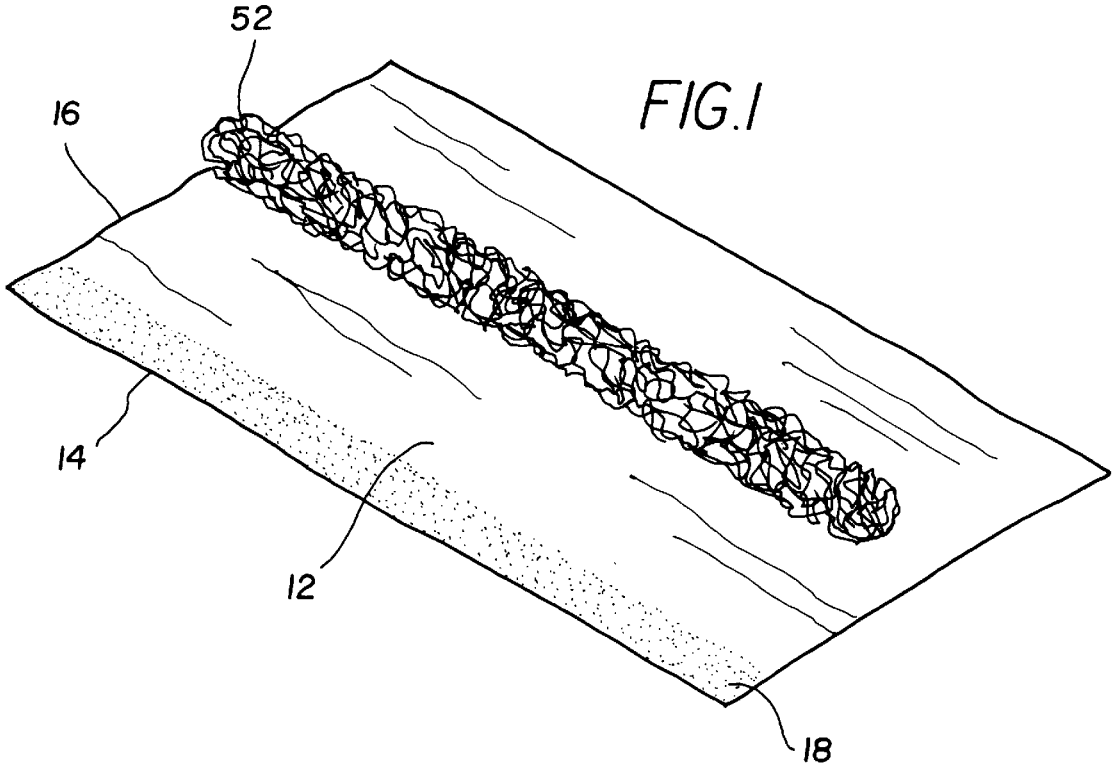
Figure 2:
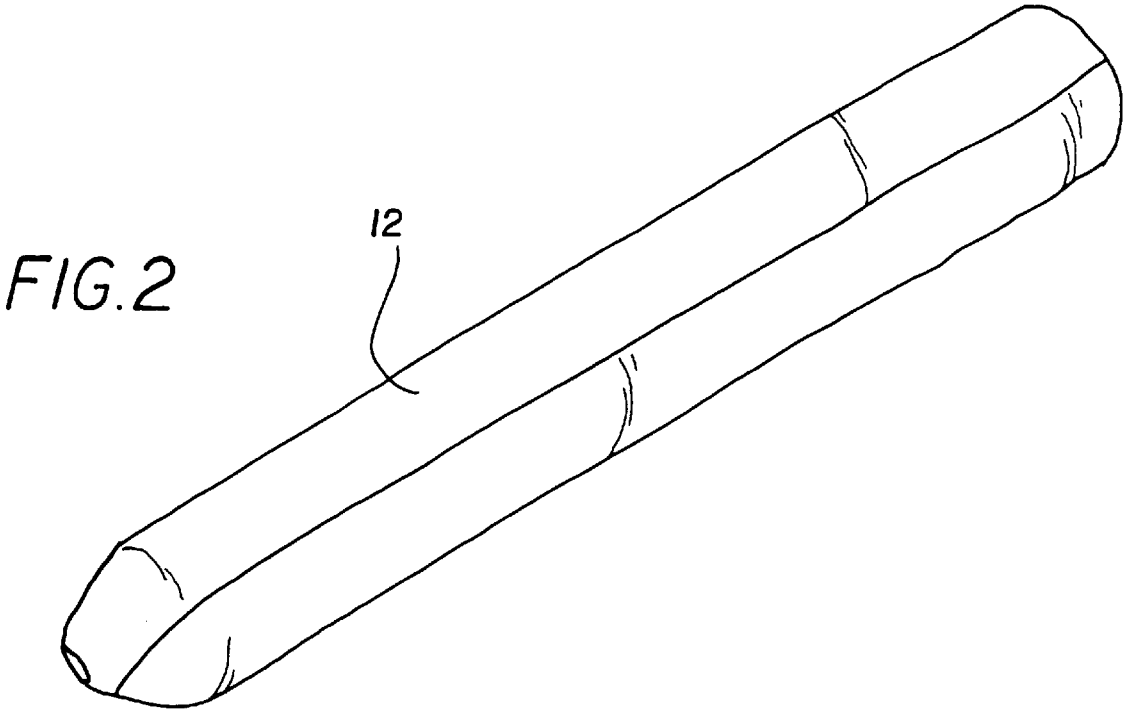
FIG. 2 is a perspective view of the present invention illustrated in a rolled configuration.
Figure 3:
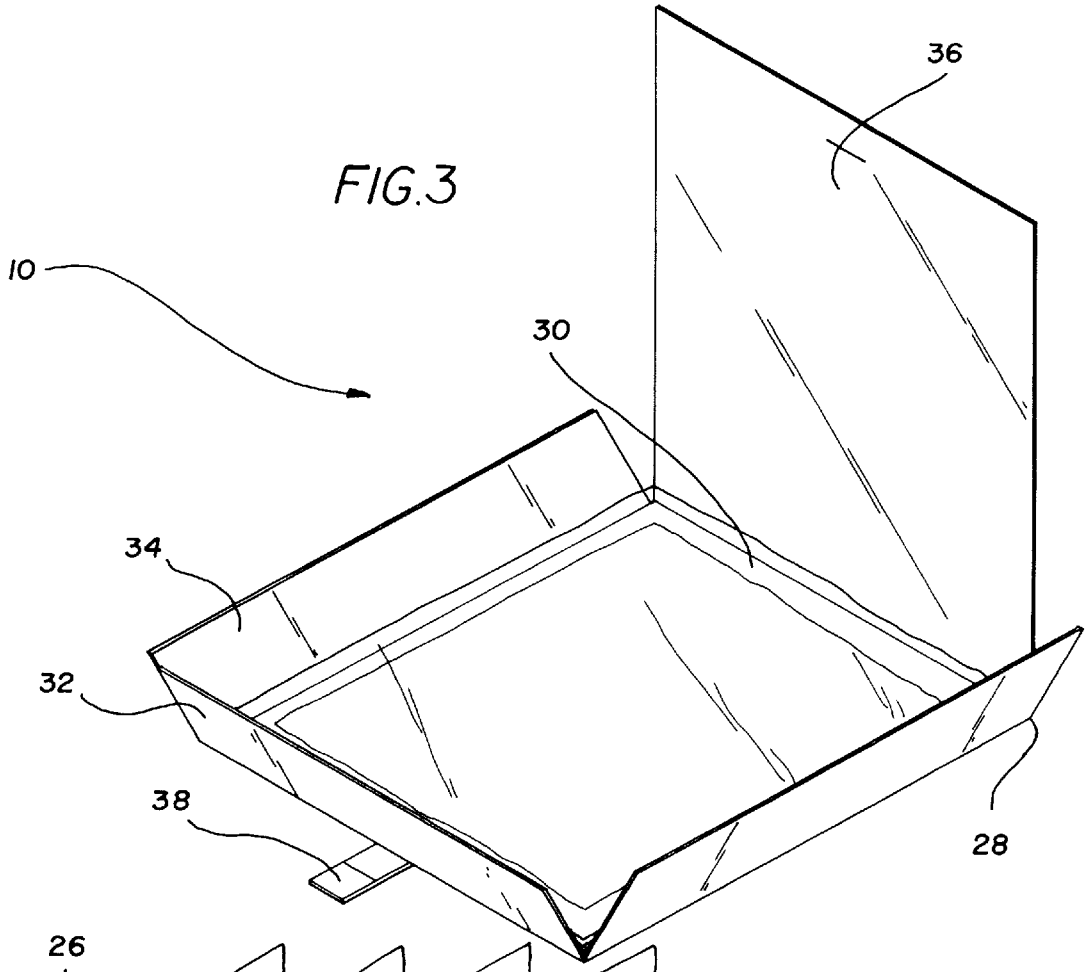
FIG. 3 is a perspective view of the closable package of the present invention.
Figure 4:
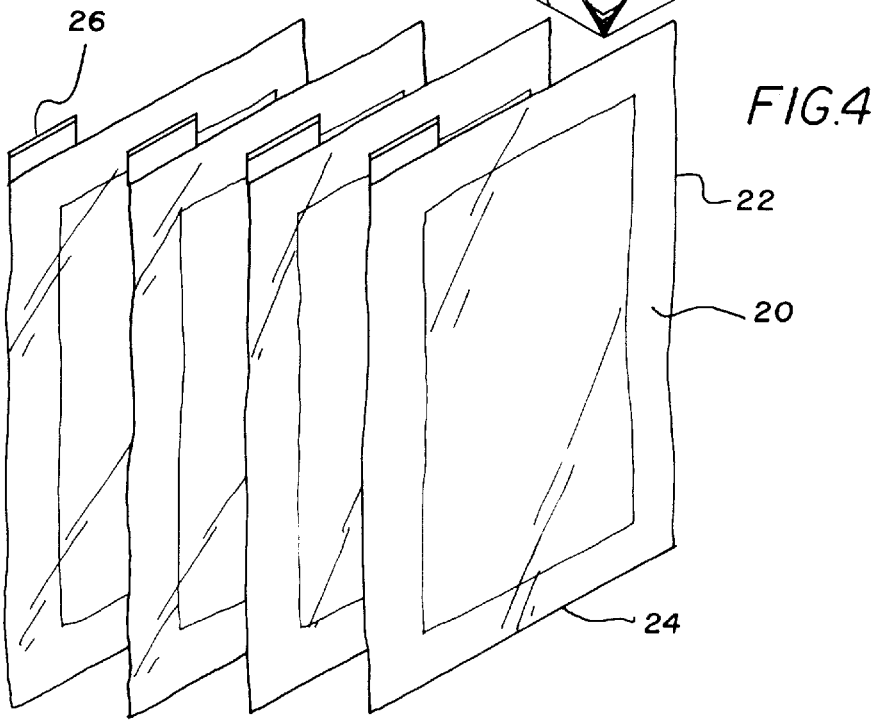
FIG. 4 is a perspective view of the present invention illustrating the cellophane sheets thereof.

With reference now to the drawings, and in particular to FIGS. 1 through 6 thereof, a new tobacco wrapping paper embodying the principles and concepts of the present invention and generally designated by the reference numeral 10 will be described.

As best illustrated in FIGS. 1 through 6, the tobacco wrapping paper 10 comprises a plurality of tobacco sheets 12 of wrapping paper. The tobacco sheets 12 of wrapping paper are comprised of a blend of tobacco and pulp products. The tobacco sheets 12 each have a generally rectangular configuration defined by opposed long edges 14 and opposed short edges 16. Each of the tobacco sheets 12 has a layer of adhesive 18 disposed thereon inwardly of one of the opposed long edges 14 thereof.

A plurality of cellophane sheets 20 are positioned intermittently between the plurality of tobacco sheets 12. The cellophane sheets 20 each have a generally rectangular configuration defined by opposed long edges 22 and opposed short edges 24. The cellophane sheets 20 have a length and width greater than a length and width of the tobacco sheets 12. One of the opposed short edges 24 of each of the cellophane sheets 20 has a tab 26 extending outwardly therefrom. The tab 26 allows for the separation from the tobacco sheets 12 to prevent unnecessary contact with the tobacco sheets 12. The cellophane sheets 20 are employed to prevent individual tobacco sheets 12 from sticking together when not in use.

A package 28 is dimensioned for containing the plurality of tobacco sheets 12 and the plurality of cellophane sheets 20 therein. The package 28 comprises a planar bottom wall 30 for receiving tobacco sheets 12 and cellophane sheets 20 thereon. The planar bottom wall 30 has a short inwardly foldable front wall 32 and short opposed inwardly foldable side walls 34 extending upwardly therefrom. A long inwardly foldable rear wall 36 extends upwardly from a rear edge of the planar bottom wall 30. The foldable rear wall 36 is dimensioned for covering the bottom wall 30 and the front wall 32 and side walls 34 in a closed orientation. The bottom wall 30 has a sealing tab 38 extending outwardly from a forward edge thereof for engaging the rear wall 36 in the closed orientation.

Figure 5:
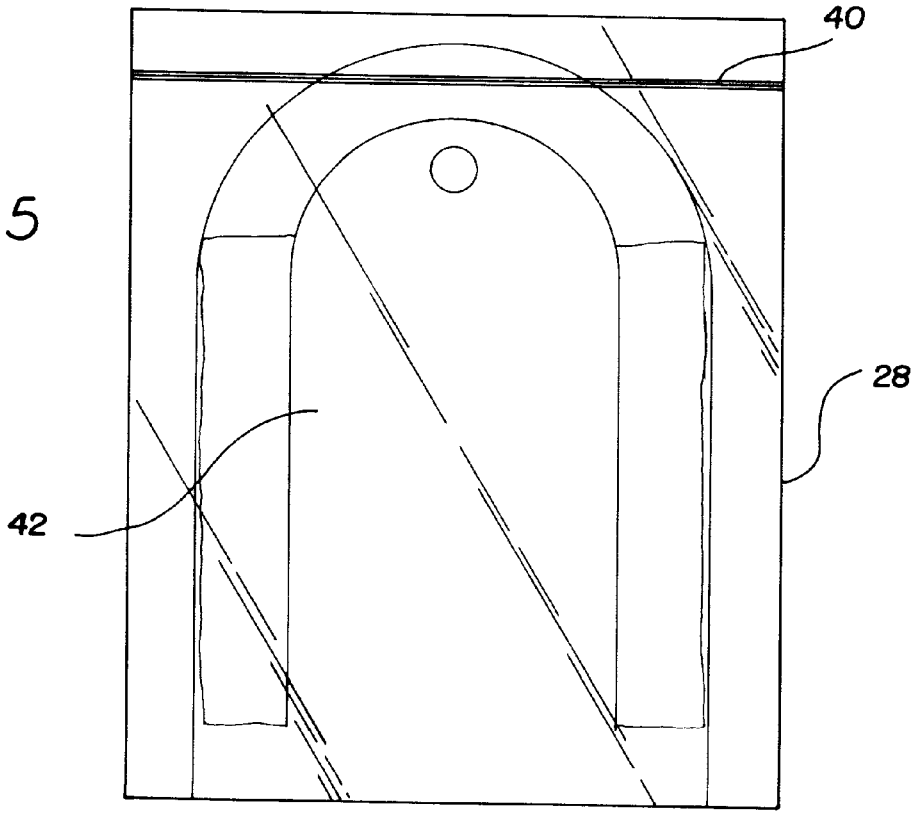
FIG. 5 is a front view of an alternate package of the present invention.
Figure 6:
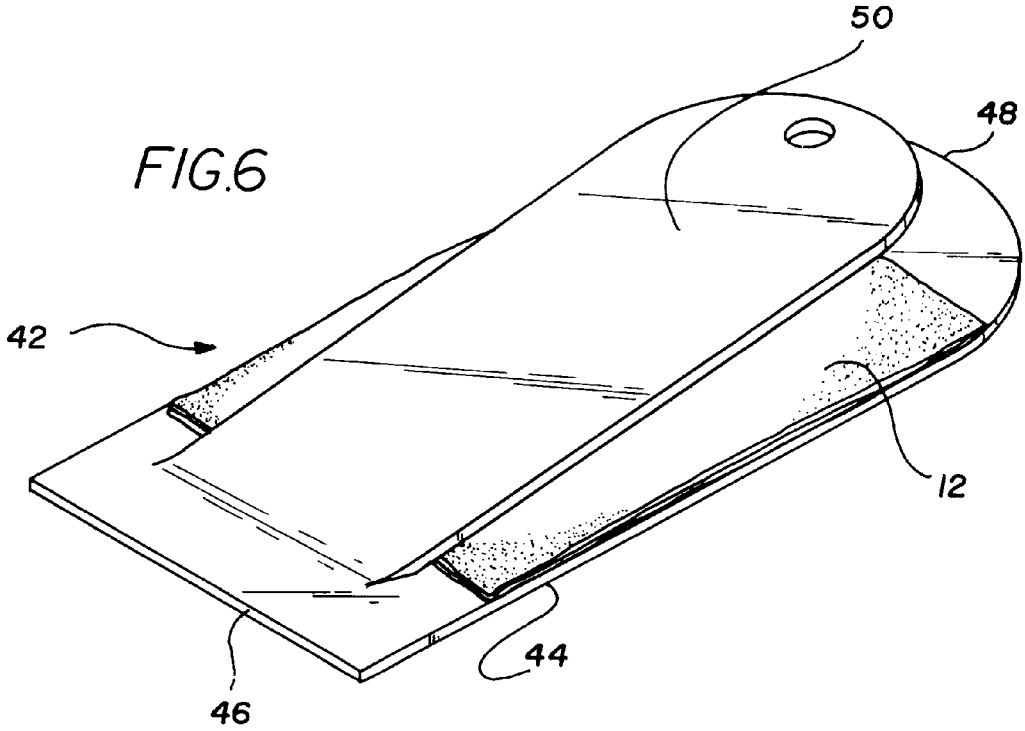
FIG. 6 is a perspective view of the plastic holder of the present invention.

An alternate embodiment of the present invention is illustrated in FIGS. 5 and 6. In this embodiment, the package 28 is a sealable plastic bag with a zip lock type closure 40. A rigid plastic holding portion 42 is dimensioned for being received within the sealable plastic bag. The holding portion 42 has a generally rectangular configuration defined by opposed long edges 44, a short lower edge 46 and an arcuate upper edge 48. A front surface of the holding portion 42 has a pliable tab 50 coupled thereto. The pliable tab 50 receives the tobacco sheets 12 for positioning against the holding portion 42. The tobacco sheets 12 can be removed simply by lifting up on the pliable tab 50. The holding portion 42 will also prevent the tobacco sheets 12 from being damaged when not in use.

In use, the present invention will be used by those persons who roll their own cigarettes or cigars. The tobacco sheets 12 can receive a quantity of tobacco 52 and be rolled into a cigar-like tube. The layer of adhesive 18 is gum-like and facilitates closure of the tobacco sheet around the quantity of tobacco 52. The tobacco sheets 12 would be processed and treated to have a paper-like consistency and high moisture retention to ensure a slow, even burn. The tobacco sheets 12 could be offered in a variety of sizes.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A new tobacco wrapping paper system for allowing a person to roll their own cigars comprising, in combination:

a plurality of tobacco sheets of wrapping paper, the tobacco sheets of wrapping paper being comprised of a blend of tobacco and pulp products, the tobacco sheets each having a generally rectangular configuration defined by opposed long edges and opposed short edges;

a package dimensioned for containing the plurality of tobacco sheets therein, wherein the package is a sealable plastic bag having a tongue and groove closure integrally formed thereon; and a plastic planar holding portion dimensioned for being received within the sealable plastic bag, the holding portion having a generally rectangular configuration defined by opposed long edges, a short lower edge and an arcuate upper edge, a front surface of the holding portion having a planar pliable tab coupled thereto, the pliable tab having a solid generally rectangular configuration defined by opposed long edges shorter than those of the holding portion, a short lower edge shorter than that of the holding portion and an arcuate upper edge shorter than that of the holding portion, wherein the short lower edge of the pliable tab is coupled to the front surface of the holding portion in parallel relationship with the short lower edge of the holding portion and spaced therefrom for defining a planar rectangular tab, the pliable tab further including an aperture formed therein adjacent to the arcuate upper edge thereof, the pliable tab receiving the tobacco sheets for positioning against the holding portion.

2. The tobacco wrapping paper as set forth in claim 1 wherein each of the tobacco sheets have a layer of adhesive disposed thereon inwardly of one of the opposed long edges thereof.

* * * * *